US005746309A

United States Patent [19]

Neyer

[11] Patent Number: 5,746,309

[45] Date of Patent: May 5, 1998

[54] RATCHET CAM ALTERNATE ACTION MECHANISM

[75] Inventor: James U. Neyer, Middleton, Wis.

[73] Assignee: Rayovac Corporation, Madison, Wis.

[21] Appl. No.: 618,528

[22] Filed: Mar. 19, 1996

[51] Int. Cl.[6] ..... H01H 19/62

[52] U.S. Cl. ..... 200/528; 200/302.2; 200/533

[58] Field of Search ..... 200/528, 526, 200/529, 533, 535, 302.2

[56] References Cited

U.S. PATENT DOCUMENTS

| | | | |
|---|---|---|---|
| 2,967,222 | 1/1961 | Bentley | 200/528 |
| 2,991,344 | 7/1961 | Benander, et al. | 200/528 |
| 3,175,065 | 3/1965 | Strader | 200/528 |
| 3,691,334 | 9/1972 | Baruffa | 200/302.2 X |
| 3,924,117 | 12/1975 | Brindley | 200/302.2 X |
| 3,943,307 | 3/1976 | Juery | 200/533 X |
| 4,175,222 | 11/1979 | Buttner . | |
| 4,288,670 | 9/1981 | Buttner | 200/303 |
| 4,777,333 | 10/1988 | Valenzona . | |
| 4,778,965 | 10/1988 | Valenzona | 200/296 |
| 4,816,626 | 3/1989 | Valenzona et al. | 200/16 F |
| 4,918,270 | 4/1990 | Orrico | 200/302.2 |
| 4,938,709 | 7/1990 | Smith et al. | 439/239 |
| 4,939,328 | 7/1990 | Smith | 200/526 |
| 4,950,856 | 8/1990 | Valenzona | 200/526 |
| 4,985,605 | 1/1991 | Valenzona | 200/528 |
| 4,997,999 | 3/1991 | Valenzona | 200/510 |
| 5,107,082 | 4/1992 | Valenzona | 200/292 |

FOREIGN PATENT DOCUMENTS

| | | | |
|---|---|---|---|
| 986363 | 7/1951 | France | 200/302.2 |
| 424100 | 2/1935 | United Kingdom | 200/528 |
| 593725 | 10/1947 | United Kingdom | 200/528 |

*Primary Examiner*—Renee S. Luebke

*Attorney, Agent, or Firm*—Thomas D. Wilhelm; Brian R. Tumm

[57] ABSTRACT

An alternate action mechanism includes a ratchet cam moving a resilient contact between first and second positions. A push button, including an interface member, rotates the ratchet cam by applying force to ratchet teeth. The alternate action mechanism includes a frame supporting the ratchet cam and aligning the ratchet portion with the interface member. In one embodiment, the ratchet portion is between two cam portions. When the ratchet cam is rotated, the cam portions moves the resilient member to one of two alternating positions. In another embodiment, the cam portion is positioned between two ratchet portions. The frame includes cam support arms receiving the ratchet cam. The frame also includes detents which prevent improper movement of the ratchet cam and provide audible indication of actuation of the mechanism. The interface member can comprise a finger to contact a ratchet tooth and rotate the ratchet cam. The finger can be U-shaped, with the edges on the open side contacting the ratchet teeth. The alternate action mechanism generally contains no spring, and can be used as an electric switch for flashlights or any other electrical devices.

65 Claims, 5 Drawing Sheets

RATCHET CAM ALTERNATE ACTION MECHANISM

FIELD OF THE INVENTION

This invention relates generally to mechanisms which respond to successive actuations by assuming alternate states, and more particularly to mechanisms of the type in which successive operations of a push button alternately move a moveable member between first and second positions. The mechanism is particularly well adapted to alternately operate electric switches.

BACKGROUND OF THE INVENTION

It is well known to equip electric switches and similar devices with push button actuators. Such actuators may be fabricated as part of the switches, or may be separately fabricated and combined with one or more switches. It is also well known to utilize push button actuators which, on successive depressions, cause switch contacts to alternately engage and disengage.

In one type of alternate switch device, means are provided for latching a push button actuator in a retracted position on alternate depressions. Such an alternate action switch is shown in U.S. Pat. No 4,175,222 to Buttner. A push button rotates a sleeve and latches the same in a projected position where the flanges are out of contact with the conductor ends. The next push button operation further rotates the sleeve, disengaging the latch dogs and allowing the coil spring to position the thimble and sleeve in a retracted position and at the same time making electric contact between the thimble and the conductor ends under the influence of a spring.

Valenzona, U.S. Pat. No. 4,985,605 discloses another alternate switch device including an electrically conductive contact cup, an electrically conductive spring, and ratchet means connected to a plunger to convert depression of the plunger into a preselected amount of rotation of the contact cup.

All of the designs require a spring to bias the push button and/or provide electrical conduction. Applicant has devised a unique mechanism in which alternate action is achieved by rotating a ratchet cam. Further, applicant has devised a unique mechanism which is free from springs and the associated switch failures caused by springs.

SUMMARY OF THE INVENTION

Some of the objects of the present invention are obtained in embodiments where an alternate action mechanism includes a ratchet cam with a cam portion that alternately moves a resilient contact between first and second positions in response to movement of the ratchet cam. A push button with an interface member rotates the ratchet cam by applying a force to ratchet teeth on a ratchet portion. The alternate action mechanism includes a frame which supports the ratchet cam and assists in properly aligning the interface member of the push button with the ratchet portion. The frame also includes one or more detents that are aligned with, and that engage, respective ratchet teeth to prevent improper movement of the ratchet cam. The detents also provide audible indication of actuation of the mechanism. Importantly, the mechanism is free from springs.

In one embodiment of the present invention the alternate action mechanism comprises a frame, and a ratchet cam supported from the frame. The ratchet cam comprises (i) a cam portion, having at least two pairs of alternating high and low cam surfaces, and (ii) a ratchet portion secured to and mounted for rotation with the cam portion. The ratchet portion includes a number of spaced ratchet teeth for facilitating rotating the ratchet cam about a first axis, an actuating apparatus for rotating the ratchet cam and actuating the alternate action mechanism by pushing against the ratchet teeth to provide a force which causes the rotation, and a resilient contact. The resilient contact is located sufficiently close to the cam portion that depressing the actuating apparatus rotates the ratchet cam and alternately actuates the resilient contact between first and second positions.

In one embodiment of the present invention, the cam portion comprises a first cam portion and a second cam portion, the first and second cam portions being disposed on opposing sides of the ratchet portion of the ratchet cam. The ratchet portion can also be disposed substantially in the center of the ratchet cam. The number of teeth for each ratchet portion is preferably an even number of spaced ratchet teeth, such as six teeth.

In another related embodiment of the present invention the ratchet cam comprises a first ratchet portion and a second ratchet portion with a cam portion disposed between the ratchet portions. The cam portion of the alternate action mechanism can be disposed substantially in the center of the ratchet cam and can contain three pairs of alternating high and low cam surfaces. The ratchet and cam portions forming the ratchet cam are rotatable about a first axis.

In a related embodiment of the present invention, the frame comprises a base structure defining an outer perimeter with an opening disposed inwardly of the outer perimeter. The frame includes a pair of ratchet cam support arms which can be secured to, and extend inwardly from, the outer perimeter of the frame, the support arms having openings therein to support the ratchet cam. A plate can be oriented in the same plane as the base structure, and can be mounted to, and extend inwardly from, the outer perimeter of the base structure, and between the ratchet cam support arms. A pair of detents can be integral with the plate and can extend inwardly beyond the plate in substantially the same direction as the cam support arms, the detents engaging respective ratchet teeth of each of first and second ratchet portions of the ratchet cam to prevent improper movement of the ratchet cam and to cause audible sound when the ratchet cam advances.

In yet another related embodiment of the present invention, the opening in the frame includes a U-shape defining an entrance thereinto at the top of the "U", the ratchet cam support arms extending from the base structure into the entrance at the top of the "U". The detents are located between the cam support arms, and the ratchet cam support arms extend a greater distance inward than the detents.

In still another embodiment of the present invention, the actuating apparatus comprises a push button including an interface member directed toward the ratchet cam, pushing the push button being effective to move the interface member toward the ratchet cam such that the interface member actuates the ratchet cam. The interface member comprises at least one finger that rotates at least one ratchet tooth of a ratchet portion when the push button is depressed. The push button requires no springs to bias or return the interface member to a retracted rest position.

In a further embodiment of the present invention, the actuating apparatus comprises a push button with an interface member having a U-shape at a distal end thereof. First and second sides of the interface member at the distal end contact respective teeth of first and second ratchet portions when the push button is depressed to rotate the ratchet cam. A hollow region in the center of the U-shaped interface member receives a cam portion of the ratchet cam when the push button is depressed, enabling the cam portion of the ratchet cam to freely rotate when the first and second ratchet portions are rotated by the interface member.

In yet another embodiment of the present invention, the resilient contact comprises an electric contact. The electric contact actuates an electric switch to a first electrical condition when the ratchet cam depresses the electric contact to a first position, and the electric contact returns to a second position when released by the ratchet cam, thereby actuating the electric switch to a second electrical condition, and causing the alternate action mechanism to alternately close and open the electric switch. An actuating apparatus rotates the ratchet cam and actuates the electric switch, while alternately actuating the resilient contact between first and second positions.

In a further embodiment of the present invention, the alternate action mechanism comprises a frame, a ratchet cam mounted to the frame for rotation with respect to a first axis and with respect to the frame, an actuating apparatus including an interface member extending toward the ratchet cam along a second axis for actuating the ratchet cam, and thus actuating the alternate action mechanism, and a resilient contact located adjacent the ratchet cam, the second axis defining a projected angle of greater than 0 degrees and up to 90 degrees with the first axis, wherein depression of the actuating apparatus moves the interface member and causes the ratchet cam to rotate and thereby to move the resilient contact between first and second positions. Preferably, the projected angle is greater than 10 degrees. An angle of substantially 90 degrees is the most preferred angle.

Yet another embodiment of the invention comprises a portable flashlight. The flashlight comprises a housing, an alternate action switch, a light source, a portable energy source, and electrical conductors. The alternate action switch is mounted through an opening in a side portion of the housing. The switch includes a frame, a resilient switch contact element, a ratchet cam supported from the frame, a push button extending through the opening in the side portion of the housing and having an interface member extending inwardly of the housing, the interface member contacting the ratchet cam when the push button is depressed. The light source is mounted in an opening in the housing. The portable energy source, having first and second electrical terminals, is contained within the housing. The electrical conductors connect the alternate action switch in a closed circuit, and include a first electrical conductor adjacent the switch contact element. The switch successively opens and closes an electrical circuit when the interface member of the push button rotates the ratchet cam and causes the resilient switch contact element to alternately move between first and second positions. In the first position the switch contact element contacts the electrical conductor and in the second position the switch contact element does not contact the electrical conductor.

The alternate action mechanism can be used as an electric switch for flashlights or other electrical devices. The alternate action mechanism can also be used to close any general electrical circuit. Further, a plurality of alternate action mechanisms can be provided to control or operate an electrical device or system.

Figure 1:
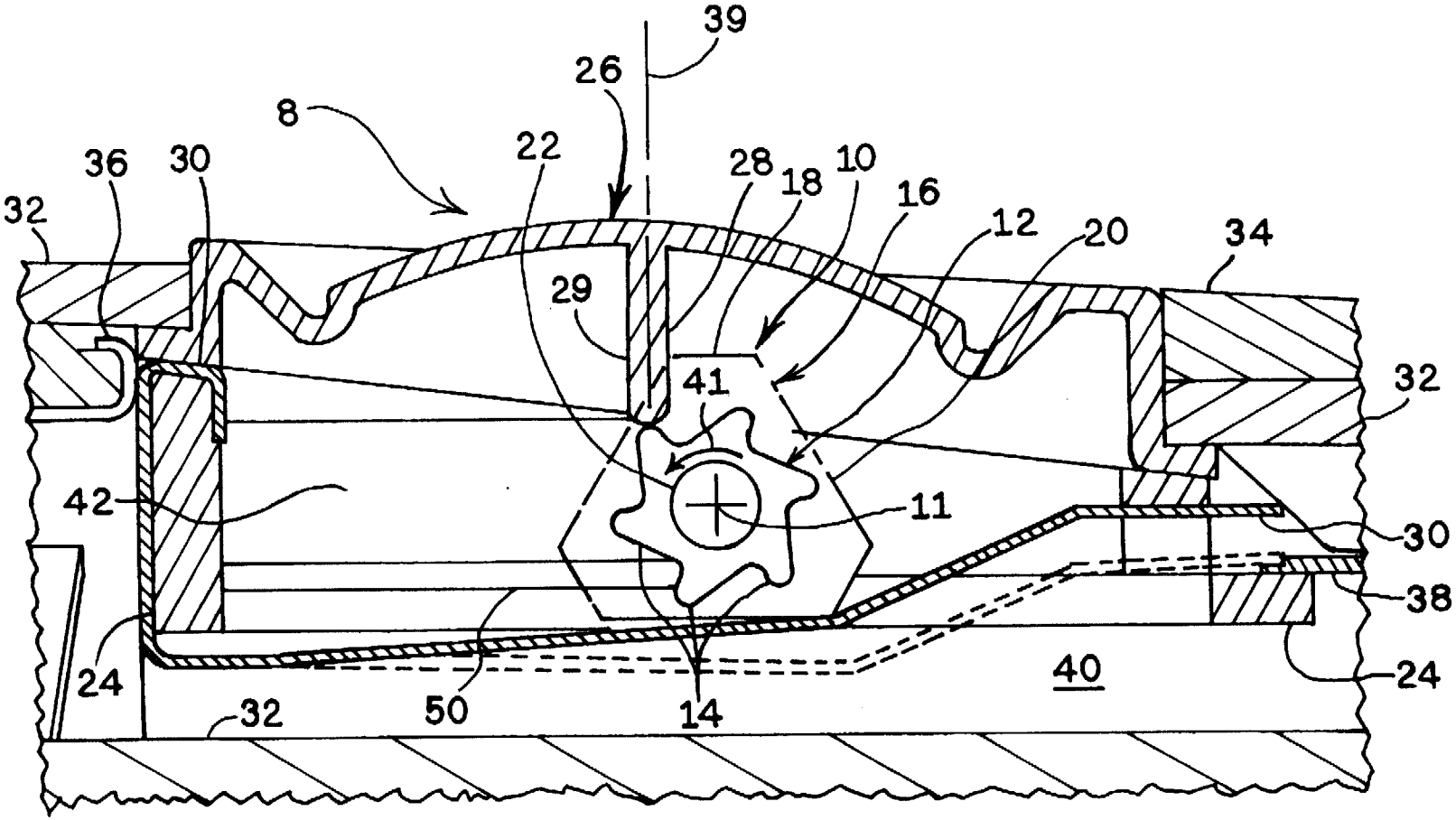
FIG. 1 shows a cross-sectional view of the alternate action mechanism mounted in an electrical device such as a flashlight.

The invention is not limited in its application to the details of construction and the arrangement of the components set forth in the following description or illustrated in the drawings. The invention is capable of other embodiments not shown or discussed explicitly herein and may be practiced or carried out in various ways. Also, it is to be understood that the terminology and phraseology employed herein is for purpose of description and illustration and should not be regarded as limiting. Like reference numerals indicate like components.

DETAILED DESCRIPTION OF THE ILLUSTRATED EMBODIMENTS

A first embodiment of the invention is shown in FIG. 1. Alternate action mechanism 8 includes a ratchet cam 10 that rotates about a first axis 11 shown in FIG. 4. Ratchet cam 10 has ratchet portion 12 that includes a number of ratchet teeth 14. Ratchet cam 10 also includes cam portion 16 having high cam surfaces 18 and low cam surfaces 20. Ratchet cam 10 also has support members 22 that permit ratchet cam 10 to be supported for rotation by frame 24 which is partially shown in FIG. 1. Alternate action mechanism 8 includes an actuating apparatus comprising resiliently deflectable push button 26 having interface member 28 extending therefrom. When push button 26 is depressed, interface member 28 contacts ratchet teeth 14 to rotate the ratchet cam and move resilient contact 30 between a first position (shown in solid outline in FIG. 1) and a second position (shown in dashed outline in FIG. 1). The cross-sectional view of FIG. 1 also shows body or housing 32 that receives alternate action mechanism 8 and plate 34. The embodiment of the invention shown in FIG. 1 has first electric contact 36 mounted to housing 32, and provides a permanent connection with resilient contact 30 of alternate action mechanism 8. Second electric contact 38 alternately engages and disengages the resilient contact 30, depending on the position of rotation of ratchet cam 10. Opening 40 in housing 32 receives resilient contact 30 and allows contact 30 to move between first and second positions.

Figure 2:
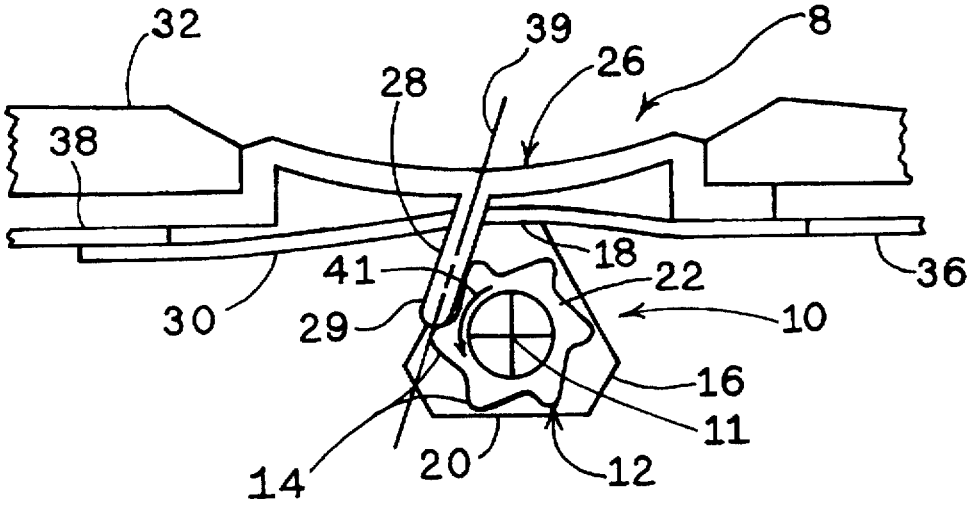
FIG. 2 shows a partial cross-sectional view of another embodiment of the alternate action mechanism with the push button depressed to actuate the ratchet cam.

FIG. 2 shows push button 26 in the actuating position. In this position, interface member 28 has a finger 29 that has moved along second axis 39 in a direction substantially perpendicular to, but not intersecting first axis 11. Finger 29 has rotated ratchet cam 10 by engaging ratchet tooth 14 and moving the ratchet tooth 14 about the axis 11 in the direction shown by the arrow 41 on the ratchet cam 10. The offset between finger 29 and axis 11 enables interface member 28 to contact a tooth 14 and rotate ratchet cam 10 in the direction of arrow 41 with each actuation. Interface member 28 may be in contact with tooth 14 of ratchet cam 10 when unactuated. Preferably, there is a slight gap, e.g. less than a millimeter, between ratchet tooth 14 and the distal end of interface member 28.

Interface member 28 and push button 26 preferably comprise rubber materials or the like. Interface member 28 must be rigid enough to force rotation of ratchet portion 12 when button 26 is pushed. Button 26 must be sufficiently deflectable to be pushed toward ratchet cam 10 to activate the switch, and sufficiently resilient to return to a retracted rest position. The drawings show push button 26 and interface member 28 as an integral unit. Alternatively, interface member 28 may be a separate element secured to push button 26, wherein interface member 28 is a material such as a hard rubber that is harder than that utilized on push button 26.

Resilient contact 30 is an electrical conductor, preferably steel or a copper alloy. Resilient contact 30 generally can have a rectangular shape in plan view. Resilient contact 30 can have slots (not shown in FIG. 2) disposed therein and through which interface member 28 of push button 26 provides contact to ratchet portion 12. FIG. 2 shows high surface 18 of cam portion 16 biasing resilient contact 30 into electrical connection with second electric contact 38. FIG. 2 shows resilient contact 30 mounted between push button 26 and ratchet cam 10 instead of below ratchet cam 10 (as shown in FIG. 1). Resilient contact 30 may be mounted at any location or angle where it can effectively engage ratchet cam 10. High cam surface 18 or low cam surface 20 must be properly aligned with resilient contact 30 during use.

Figure 3:
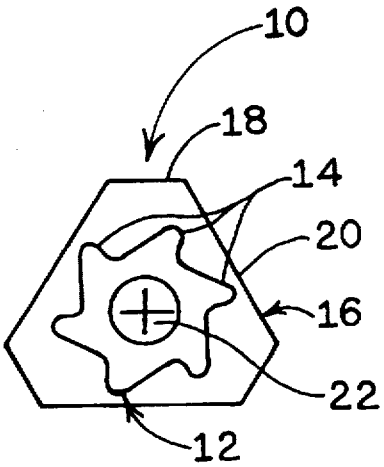
FIG. 3 shows a side view of a first embodiment of the ratchet cam.

FIG. 3 shows a side view of ratchet cam 10. Ratchet cam 10 preferably has an even number of spaced ratchet teeth 14 on ratchet portion 12. The number of ratchet teeth 14 is preferably the same as the total number of high and low cam surfaces 18 and 20 on cam portion 16. Each ratchet tooth 14 corresponds to a particular cam surface 18 or 20 so that different cam surfaces 18 or 20 can be positioned at or adjacent resilient contact 30 upon each actuation of ratchet cam 10 by push button 26. While a wide number of ratchet teeth 14 may be used in the present invention, six ratchet teeth 14 and corresponding cam surfaces 18 and 20 provide a preferred alternate action mechanism 8. Preferably, ratchet teeth 14 are substantially equally spaced about ratchet portion 12.

At least two pairs of alternating high and low cam surfaces 18 and 20 are contemplated in the invention, although any number exceeding two pairs can be used. The preferred number of high and low cam surfaces 18 and 20 is three pairs (as shown in FIG. 3).

Figure 4:
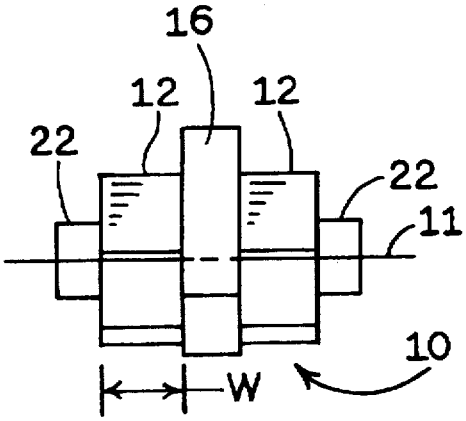
FIG. 4 shows a front view of the ratchet cam shown in FIG. 3.

FIG. 4 is a front view of ratchet cam 10 of FIG. 3 showing two ratchet portions 12 on either side of cam portion 16. Support members 22 are disposed on opposing surfaces of left and right ratchet portions 12. As shown in FIGS. 3 and 4, cam portion 16 includes three equally spaced flat high cam surfaces 18 and three equally spaced flat low cam surfaces 20 disposed therebetween. Each ratchet portion 12 includes six equally spaced teeth asymmetrically configured to engage interface member 28 on only one side for rotation of the ratchet cam 10 in the counterclockwise direction as in FIG. 1. The asymmetric structure of ratchet teeth 14 avoids improper engagement of interface member 28 on the wrong side of ratchet teeth 14. The engagement side, shown in FIG. 2, is common for all of ratchet teeth 14. Thus, if interface member 28 inadvertently interfaces with a tooth 14 for rotation of ratchet portion 12 in the clockwise direction, the asymmetric structure of the tooth deflects interface member 28, and interface member 28 slips off the tooth without rotating ratchet portion 12.

As illustrated in FIGS. 1–4, the entire ratchet portion 12 is contained within the side-view outline of cam portion 16. Thus, any overlap of contact 30 onto the width "W" of a ratchet portion 12 may occur without the ratchet portion touching contact 30. Accordingly, ratchet portion 12 does not interfere with normal movement of resilient contact 30 into and out of engagement with contact 38.

Figure 9:
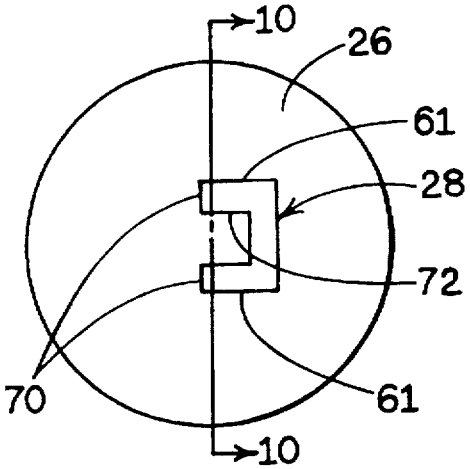
FIG. 9 shows a bottom view of a preferred push button.
Figure 10:
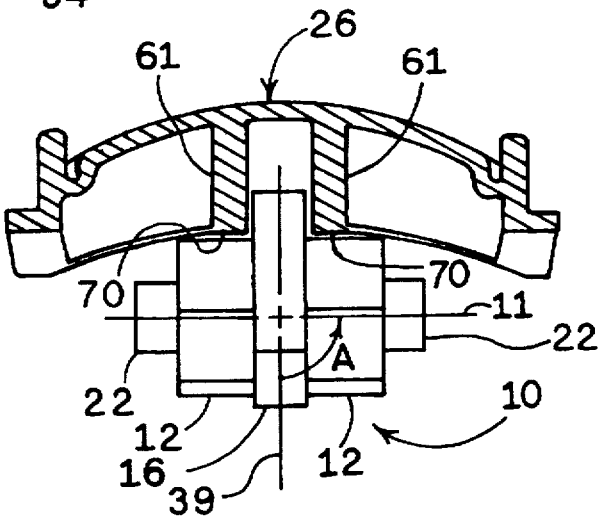
FIG. 10 shows a cross-sectional view of the preferred push button for the alternate action mechanism taken at 10—10 of FIG. 9, and including the ratchet cam of FIG. 4.

Interface member 28 can be a pair of fingers. Alternatively, interface member 28 can have a U-shape as shown in FIGS. 9 and 10, or other structure. Whatever the structure, the interface member 28 contacts first and second ratchet portions 12 and rotates ratchet cam 10. Interface member 28 contacts both ratchet portions 12 with sufficient force to rotate ratchet cam 10 about axis 11. As shown in FIG. 4, ratchet portions 12 and cam portion 16, and preferably support members 22, all rotate together. Ratchet portions 12, cam portion 16, and support members 22 can all comprise separate piece parts, or may be one integral piece of material. Ratchet portion 12, cam portions 16, and support members 22 can be made of a wide variety of materials such as acetal, nylon, other plastics, or any other appropriate material.

Figure 5:
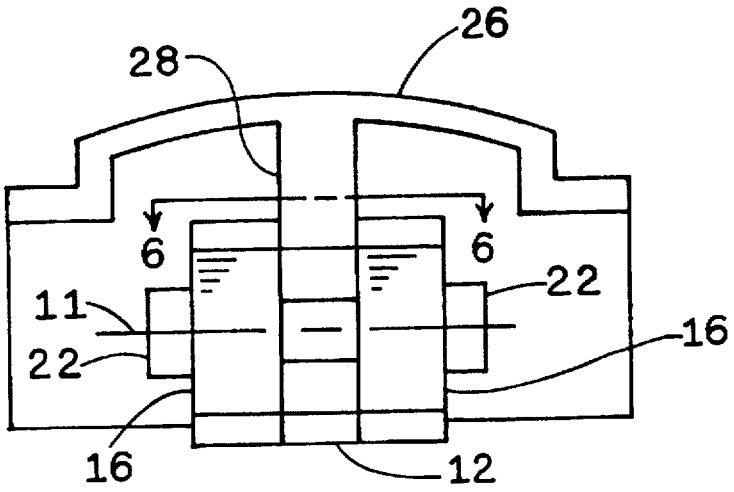
FIG. 5 shows a cross-sectional view of a second embodiment of the ratchet cam and the push button which actuates the ratchet cam.
Figure 6:
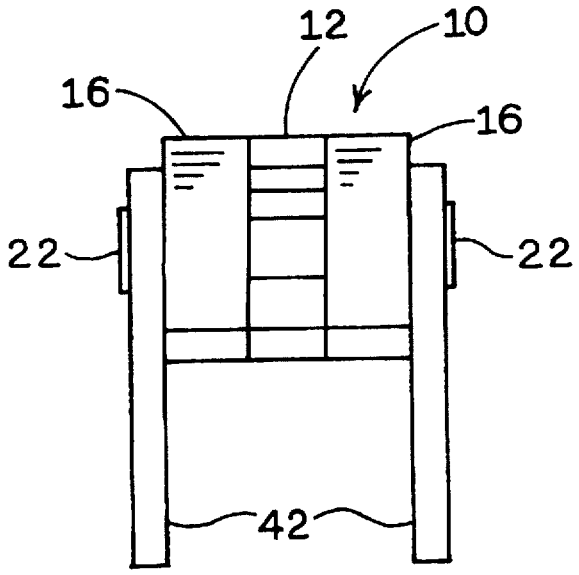
FIG. 6 shows a top view of the ratchet cam from the embodiment of FIG. 5 taken at 6—6 of FIG. 5.

FIGS. 5 and 6 illustrate an alternative embodiment from the ratchet cam shown in FIGS. 3 and 4. In FIG. 5 ratchet portion 12 is in substantially the center of ratchet cam 10 and between first and second cam portions 16. Ratchet portions 12, cam portions 16 and support members 22 can be separately glued, welded or otherwise attached elements, or one integral piece of material forming ratchet cam 10 as in the previous embodiment. Interface member 28 of push button 26 rotates the ratchet portion and therefore the entire ratchet cam 10 by contacting ratchet teeth 14. Cam portion 16 alternates resilient contact 30 as described earlier, between first and second positions.

FIG. 6 shows ratchet cam 10 of FIG. 5 attached to ratchet cam support arms 42 of frame 24. Support arms 42 locate ratchet cam 10 in proper placement with respect to push button 26 and resilient contact 30.

Figure 7:
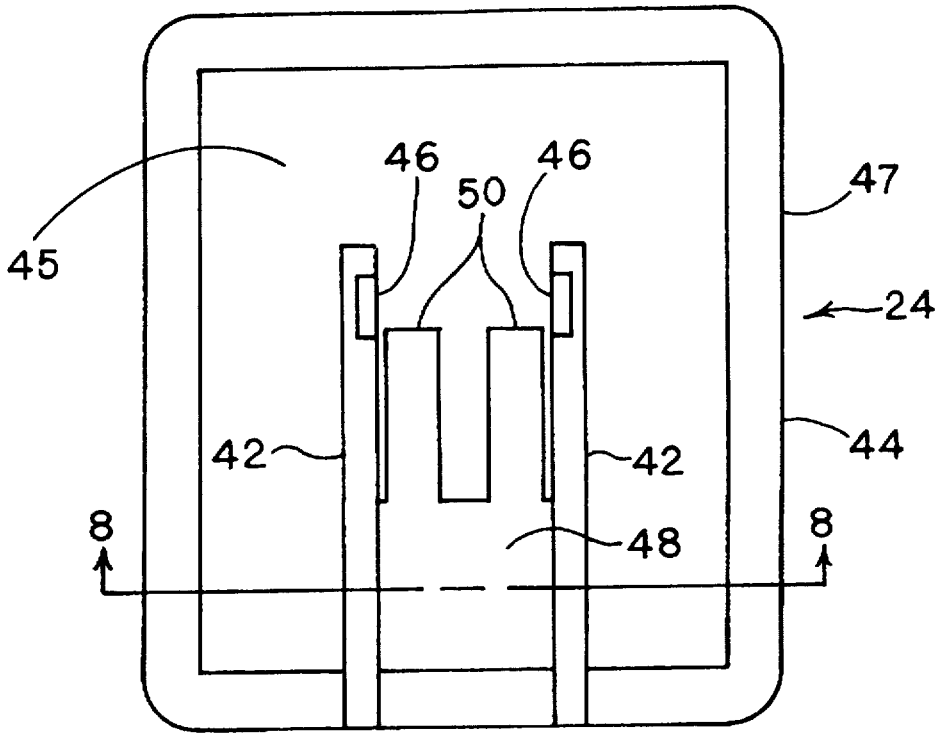
FIG. 7 shows a preferred embodiment of a frame for the alternate action mechanism.

FIGS. 7 and 8A show a preferred embodiment of frame 24. Frame 24 comprises a base structure 44. Base structure 44 defines an outer perimeter 47 having a rectangular shape. A U-shaped opening 45 is defined within outer perimeter 47. One side of the base structure has first and second inwardly directed ratchet cam support arms 42. The lower surfaces of support arms 42 are in substantially the same plane as the lower surface of base structure 44. Support arms 42 extend into and thus define the top of U-shaped opening 45. Each support arm 42 has an opening 46 to receive and retain the respective support member 22 of ratchet cam 10. Inwardly facing plate 48 of frame 24 is between support arms 42. Plate 48 can be separate from, or integral with support arms 42. Plate 48 is oriented in the same plane as the lower surface of base structure 44. The inward side or end of plate 48 contains a pair of spaced detents 50, located between cam support arms 42 as shown in FIG. 7. Detents 50 of frame 24 contact ratchet teeth 14 of ratchet portion 12 to prevent opposite improper movement of ratchet cam 10 in a direction opposite that shown by arrow 41. Detents 50 also provide audible sound at each advance of ratchet cam 10. This audible sound confirms to the user, successful actuation of alternate action mechanism 8.

Figure 8:
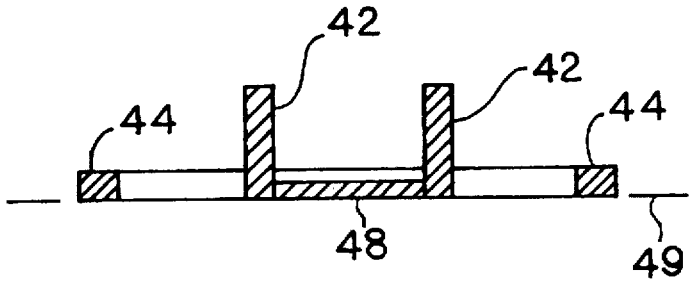
FIG. 8 shows a cross-sectional view of the frame of FIG. 7 taken at 8—8 of FIG. 7.

The lower surface of base structure 44 is contained in a base plane 49, illustrated in FIG. 8. Cam support arms 42, and especially openings 46, are preferably spaced upwardly from base plane 49 and inwardly of outer perimeter 47. High cam surfaces 18 of ratchet cam 10 extend a small distance below frame 24 to move resilient contact 30 to the first position (shown in dashed outline in FIG. 1) engaging second electric contact 38. The members of frame 24, including ratchet cam support arms 42, base structure 44, plate 48 and detents 50, preferably are formed as one integral piece of plastic, such as acetal, nylon or the like. The members of frame 24 can also be formed in part or in total by separate individual elements which are glued, welded or otherwise secured to one another.

Resilient contact 30 can be supported from frame 24. Frame 24 can be secured to housing 32 in any conventional manner. FIG. 1 shows frame 24 supporting push button 26 and mounted in housing 32.

FIG. 8 shows a cross-sectional view of frame 24, further illustrating the relationship between the elements. The height of ratchet cam support arms 42 with respect to the base plane 49 is clearly shown. The relative size of plate 48 mounted between and attached to ratchet cam support arms 42 is also apparent. Plate 48 has a smaller thickness than ratchet cam support arms 42 or base structure 44.

While FIGS. 7 and 8 show one embodiment of frame 24, other embodiments are contemplated. Such other embodiments have the same effect of supporting ratchet cam 10 and resilient contact 30.

FIGS. 9 and 10 illustrate one embodiment of push button 26. Push button 26 and especially interface member 28 are formed from a material having sufficient rigidity to enable interface member 28 to advance ratchet cam 10 when push button 26 is pushed. Push button 26 and interface member 28 preferably comprise one integral element. Push button 26 and interface member 28 may comprise two separate elements glued or otherwise secured to each other. FIG. 9 shows a bottom view of push button 26, clearly showing the preferred U-shaped configuration of interface member 28, including opposing sides 61. Interface member 28 is designed to rotate ratchet cam 10 of FIGS. 3, 4 and 10 which have two ratchet portions 12. In use, the distal ends 70 of the sides 61 initially engage respective teeth 14 on first and second ratchet portions 16. Upon further depression of push button 26, the distal ends 70 push on the respective teeth 14, thus effecting rotation of ratchet cam 10. Hollow region 72 is disposed between the sides 61, and substantially in the center of the U-shaped interface member 28. Region 72 provides a space in which cam portion 16 rotates freely as ratchet cam 10 is rotated when push button 26 is depressed.

First axis of rotation 11 and second axis 39 of interface member 28 together define a projected angle "A" of greater than 0 degrees up to 90 degrees, illustrated in FIG. 10. Preferably, the angle "A" is at least greater than 10 degrees. More preferably, the angle "A" is greater than 45 degrees and most preferably the angle "A" is substantially 90 degrees. The angle "A" must be sufficiently great that interface member 28 engages and rotates ratchet cam 10 when the alternate action mechanism 8 is activated by a user.

Figure 11:
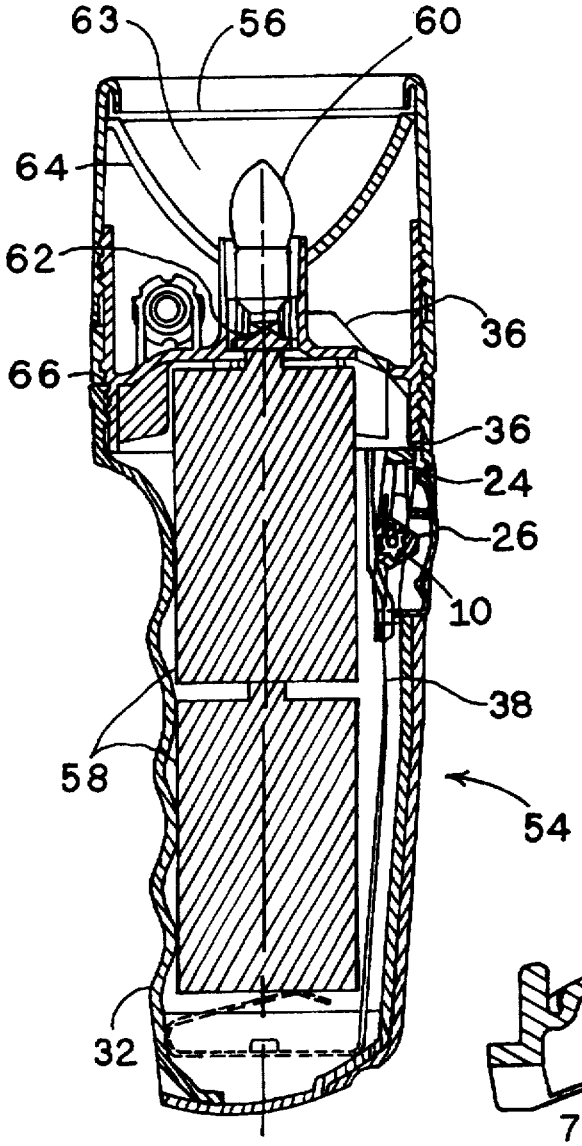
FIG. 11 shows the alternate action mechanism mounted with a portable flashlight to provide alternate actuation of an electric contact.

FIG. 11 shows alternate action mechanism 8 positioned within a portable flashlight 54. The flashlight includes the housing 32 and a lens 56. Second electric contact 38 comprises a spring strip contact having a first end connected to the negative terminal of power source 58 and a second end disposed to connect with resilient contact 30, thus closing the electric circuit. The electric circuit includes the first contact 36, connected to light bulb 60 which is mounted within opening 63 of housing 32. Bulb 60 is connected by third electric contact 62 to the positive terminal of power source 58. Power source 58 comprises two batteries connected in series. Other well known arrangements for the power source are contemplated.

FIG. 11 also illustrates reflector 64 which directs light from the bulb outwardly through lens 56. Portable flashlight 54 also includes seal 66 to keep water or other liquids out of housing 32. The electrical circuit of flashlight 54 operates when push button 26 is depressed to rotate ratchet cam 10. This rotation causes resilient contact 30 to move between a first position activating bulb 60 and a second position which opens the circuit and terminates activation of bulb 60.

Depressing push button 26 causes distal ends 70 of interface member 28 to engage ratchet teeth 14. Further deflection of push button 26 causes ratchet teeth 14 to move, rotating ratchet cam 10. Detents 50 contact ratchet teeth 14 to prevent improper movement of ratchet cam 10. Cam support arms 22 properly position openings 46 to properly position ratchet cam 10 with respect to resilient contact 30, detents 50 and interface member 28. As ratchet cam 10 rotates cam portion 16, thus engaging or releasing resilient contact 30, contact 30 is resiliently deflected, against spring-like resistance. Successive engaging and releasing of contact 30, respectively closes and opens the circuit, turning bulb 60 successively on and off alternately.

While only a single alternate action mechanism 8 is shown, the invention contemplates a plurality of alternate action mechanisms 8 to operate an electrical device or system. For example, such mechanisms can be used to operate devices such as stereos, portable radios, or compact disc players which can utilize the alternate action switch as a power switch.

While the illustrated embodiments show alternate action mechanism 8 operating to open and close an electric switch, the mechanism can also be used as a non-electric switch.

Preferably, resilient contact 30 comprises an electric contact which actuates an electric switch to a first electrical condition when the high and low ratchet cam surfaces 18, 20 locate the resilient contact 30 in a first position, such as "on". The electric switch returns to a second position when released by ratchet cam surfaces 18 and 20 to place the electric switch in a second electrical condition, such as "off".

Further, the invention improves on prior art by not utilizing a spring as an electric contact or to bias the actuation apparatus which comprises push button 26. Thus the alternate action mechanisms of the invention cannot suffer from disabling spring failure since, in the preferred embodiments there is no spring. The cost of parts, and of assembling the mechanism, is also less due to the absence of springs.

As used herein, "spring" refers to a coiled or like biasing article used to bias a second element against or away from a third element.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. An alternate action mechanism, comprising:

(a) a frame;

(b) a ratchet cam supported from said frame, said ratchet cam comprising (i) a cam portion, having at least two pairs of alternating high and low cam surfaces, said cam portion being substantially centered in said ratchet cam, and (ii) a ratchet portion secured to and mounted for rotation with said cam portion, said ratchet portion including a number of spaced ratchet teeth facilitating rotating of said ratchet cam about a first axis;

(c) actuating apparatus rotating said ratchet cam and thereby actuating said alternate action mechanism by pushing against said ratchet teeth to provide a force causing the rotation; and (d) a resilient contact sufficiently close to said cam portion of said ratchet cam, that depressing said actuating apparatus rotates said ratchet cam and alternately actuates said resilient contact between first and second positions;

said alternate action mechanism being free from coil springs.

2. An alternate action mechanism as in claim 1 wherein said cam portion comprises three pairs of said alternating high and low cam surfaces.

3. An alternate action mechanism as in claim 1 wherein said ratchet portion of said ratchet cam comprises an even number of said teeth.

4. An alternate action mechanism as in claim 1 wherein said resilient contact comprises an electric contact, actuating an electric switch to a first electrical condition when said ratchet cam moves said electric contact to the first position, said electric contact returning to the second position when released by said ratchet cam, thereby actuating said electric switch to a second electrical condition and causing said alternate action mechanism to alternately close and open said electric switch upon successive actuations of said apparatus.

5. An alternate action mechanism as in claim 1 wherein said ratchet portion of said ratchet cam comprises a first ratchet portion on a first side of said cam portion, said ratchet cam including a second ratchet portion on a second side of said cam portion, said second ratchet portion comprising spaced ratchet teeth assisting in rotating said ratchet cam.

6. An alternate action mechanism as in claim 5 wherein said first ratchet portion, said second ratchet portion, and said cam portion rotate about said first axis.

7. An alternate action mechanism as in claim 5, said actuating apparatus comprising a push button, said push button including an interface member directed toward said ratchet cam, said interface member having a distal end thereof having a U-shape, first and second sides of said interface member at the distal end thereof contacting respective said teeth of said first and second ratchet portions of said ratchet cam when said push button is depressed to rotate said ratchet cam.

8. An alternate action mechanism as in claim 7 wherein a hollow region in said U-shaped interface member receives said cam portion when said push button is depressed, enabling said cam portion of said ratchet cam to rotate freely therein when said first and second ratchet portions of said ratchet cam are rotated by said interface member.

9. An alternate action mechanism as in claim 1 wherein said frame comprises a base structure defining an outer perimeter of said frame, and an opening disposed inwardly of the outer perimeter, and first and second ratchet cam support arms secured to and extending inwardly from the outer perimeter of said frame.

10. An alternate action mechanism as in claim 9, and further comprising a plate mounted to and extending inwardly from the outer perimeter of said base structure and between said first and second ratchet cam support arms.

11. An alternate action mechanism as in claim 10, a pair of detents being integral with said plate and extending inwardly of the outer perimeter beyond said plate in substantially the same direction as said cam support arms, said ratchet portion comprising a first ratchet portion, said ratchet cam including a second ratchet portion, said second ratchet portion comprising spaced ratchet teeth for assisting in rotating said ratchet cam, said detents engaging respective said teeth of each of said first and second ratchet portions, to prevent improper movement of said ratchet portion.

12. An alternate action mechanism as in claim 11 wherein said detents are located between said ratchet cam support arms, said ratchet cam support arms extending a greater distance inward than said pair of detents.

13. An alternate action mechanism as in claim 11 wherein said detents of said frame cause audible sound when said ratchet cam advances.

14. An alternate action mechanism as in claim 11 wherein each said cam support arm has an opening therein receiving said ratchet cam.

15. An alternate action mechanism as in claim 9, said ratchet cam support arms extending inwardly from said outer perimeter and, together with said outer perimeter, defining a "U-shaped" void between said outer perimeter and said ratchet cam support arms.

16. An alternate action mechanism as in claim 15, a pair of detents being mounted to said base structure and extending inwardly into the opening in substantially the same direction as said cam support arms, said detents being located between said cam support arms, said ratchet portion comprising a first ratchet portion, said ratchet cam including a second ratchet portion, said second ratchet portion comprising spaced ratchet teeth for assisting in rotating said ratchet cam, said detents engaging respective said teeth of each of said first and second ratchet portions, to prevent improper movement of said ratchet portion.

17. An alternate action mechanism as in claim 1 wherein said actuating apparatus comprises a push button, said push button including an interface member directed toward said ratchet cam, pushing said push button being effective to move said interface member toward said ratchet cam and thereby to actuate said ratchet cam.

18. An alternate action mechanism as in claim 17 wherein said interface member comprises at least one finger, said at least one finger rotating said ratchet portion of said ratchet cam when said push button is depressed.

19. An alternate action mechanism as in claim 17 wherein said first axis of rotation of said ratchet cam defines an angle with respect to the direction of movement of said interface member of greater than 0 degrees.

20. An alternate action mechanism as in claim 19 wherein said first axis of rotation of said ratchet cam is substantially perpendicular to the direction of movement of said interface member.

21. An alternate action mechanism comprising:

(a) a frame;

(b) a ratchet cam mounted to said frame, for rotation with respect to a first axis and with respect to said frame, said ratchet cam comprising a cam portion having at least two pairs of alternating high and low cam surfaces, and a ratchet portion mounted for rotation with said cam portion;

(c) actuating apparatus, including an interface member thereof extending toward said ratchet cam along a second axis, for actuating said ratchet portion and thereby rotating said ratchet cam, and thus actuating said alternate action mechanism; and (d) a resilient contact located adjacent said ratchet cam, depressing said actuating apparatus being effective to move said interface member into contact with said ratchet portion of said ratchet cam and thus to rotate said high and low cam surfaces of said cam portion of said ratchet cam and thereby to move said resilient contact between first and second positions, said high cam surfaces of said cam portion alternatingly extending beyond said frame.

22. An alternate action mechanism as in claim 21, said ratchet portion comprising first and second ratchet portions, and including an even number of ratchet teeth on each of said first and second ratchet portions.

23. An alternate action mechanism as in claim 21 wherein said interface member is substantially perpendicular to said first axis.

24. An alternate action mechanism as in claim 21, said interface member being comprised in a push button, said interface member having at least one finger, contacting at least one tooth of said ratchet portion of said ratchet cam, when said push button is depressed.

25. An alternate action mechanism as in claim 21 wherein said resilient contact comprises an electric contact, actuating an electric switch to a first electrical condition when said high cam surface of said cam portion moves said electric contact to the first position, said electric contact returning to the second position when said cam portion releases said electric contact, thereby actuating said electric switch to a second electrical condition, and causing said alternate action mechanism to alternately close and open said electric switch upon successive actuations of said mechanism.

26. An alternate action mechanism as in claim 21 wherein said mechanism is free from coil springs.

27. An alternate action mechanism as in claim 21 wherein said ratchet portion comprises first and second ratchet portions mounted for rotation with said cam portion, said first and second ratchet portions each comprising spaced ratchet teeth, said interface member having a distal end thereof having a U-shape, the distal end of said interface member contacting said ratchet teeth of said first and second ratchet portions when said push button is depressed and thereby rotating said ratchet cam.

28. An alternate action mechanism as in claim 27 wherein a hollow region in said U-shaped interface member receives said cam portion when said push button is depressed, enabling said cam portion of said ratchet cam to rotate freely therein when said first and second ratchet portions of said ratchet cam are rotated by said interface member.

29. An alternate action mechanism as in claim 21 wherein said frame comprises a base structure including an outer perimeter of said frame, an opening through said base structure being disposed inwardly of the outer perimeter, and a pair of ratchet cam support arms secured to and extending inwardly from the outer perimeter of said frame.

30. An alternate action mechanism as in claim 29, said ratchet cam support arms extending from said base structure into the opening.

31. An alternate action mechanism as in claim 30 wherein said frame further comprises a pair of detents mounted to said base structure and extending inwardly into the opening in substantially the same direction as said cam support arms, said detents being located between said cam support arms, said ratchet cam including first and second ratchet portions, each said ratchet portion having spaced ratchet teeth assisting in rotating said ratchet cam, said detents engaging respective said teeth of each of said first and second ratchet portions of said ratchet cam to prevent improper movement of said ratchet portion.

32. An alternate action mechanism as in claim 29, further comprising a plate mounted to and extending inwardly from the outer perimeter of said base structure and between said ratchet cam support arms.

33. An alternate action mechanism as in claim 32 wherein said frame further comprises a pair of detents integral with said plate and extending inwardly beyond said plate in substantially the same direction as said cam support arms, said ratchet cam including first and second ratchet portions, each of said first and second ratchet portions having ratchet teeth, said detents engaging said ratchet teeth to prevent improper movement of said ratchet cam.

34. An alternate action mechanism as in claim 33 wherein each said cam support arm has an opening therein receiving said ratchet cam.

35. An alternate action mechanism as in claim 23 wherein said detents are located between said ratchet cam support arms, said ratchet cam support arms extending a greater distance inward than said pair of detents.

36. An alternate action mechanism as in claim 35 wherein said detents of said frame cause audible sound when said ratchet cam advances.

37. An alternate action mechanism, comprising:

(a) a ratchet cam comprising a cam portion including at least two pairs of alternating high and low cam surfaces, and a ratchet portion comprising spaced ratchet teeth, said ratchet cam being rotatable about an axis, said high cam surfaces alternately extending beyond said frame in response to rotation of said ratchet cam;

(b) a frame rotatably supporting said ratchet cam, said frame comprising (i) a base structure defining an outer perimeter of said frame and an opening in said frame inwardly of the outer perimeter, and (ii) a pair of ratchet cam support arms secured to and extending inwardly from said frame at the outer perimeter;

(c) actuating apparatus rotating said ratchet cam and thereby actuating said alternate action mechanism; and (d) a resilient contact supported adjacent said ratchet cam, depressing said actuating apparatus rotating said ratchet cam and alternately actuating said resilient contact between first and second positions.

38. An alternate action mechanism as in claim 37 wherein said resilient contact comprises an electric contact, actuating an electric switch to a first electrical condition when said ratchet cam moves said electric contact to the first position, said electric contact returning to the second position when released by said ratchet cam, thereby actuating the electric switch to a second electrical condition, and causing said alternate action mechanism to alternately close and open the electric switch upon successive actuations of said apparatus.

39. An alternate action mechanism as in claim 37 wherein said mechanism is free from coil springs.

40. An alternate action mechanism as in claim 37 wherein said frame further comprises a plate oriented in substantially the same plane as said base structure and mounted to and extending inwardly from one side of the outer perimeter, said ratchet cam support arms extending inwardly of the outer perimeter beyond said plate.

41. An alternate action mechanism as in claim 40, said ratchet portion comprising a first ratchet portion and said ratchet cam including a second ratchet portion having spaced ratchet teeth, and wherein said frame further comprises a pair of detents integral with said plate and extending inwardly beyond said plate in substantially the same direction as said cam support arms, said detents being arranged to contact the respective ratchet teeth of said first ratchet portion and said second ratchet portion, said detents being located between said ratchet cam support arms, and preventing improper movement of said ratchet cam.

42. An alternate action mechanism as in claim 37, said actuating apparatus comprising a push button, said push button including an interface member extending toward said ratchet cam, and actuating said ratchet cam.

43. An alternate action mechanism as in claim 42 wherein said interface member of said push button comprises at least one finger contacting at least one ratchet tooth of said ratchet portion of said ratchet cam when said push button is depressed.

44. An alternate action mechanism as in claim 37, said ratchet portion comprising a first ratchet portion, and said ratchet cam comprising a second ratchet portion having ratchet teeth, said actuating apparatus comprising a push button, including an interface member, said interface member being directed toward said ratchet cam, said interface member having a distal end thereof having a U-shape, the distal end of said interface member contacting said ratchet teeth of said first and second ratchet portions, when said push button is depressed and thereby rotating said ratchet cam.

45. An alternate action mechanism as in claim 44, said cam portion being received in a hollow region in said U-shaped interface member, said hollow region enabling said cam portion of said ratchet cam to rotate freely therein when said first and second ratchet portions of said ratchet cam are rotated by depressing said push button.

46. An alternate action mechanism as in claim 37 wherein said ratchet cam rotates about an axis, and comprises a cam portion, comprising at least two pairs of alternating high and low cam surfaces, and a ratchet portion, comprising spaced ratchet teeth, said ratchet teeth rotating with respect to the axis in response to a force applied by said actuating apparatus.

47. An alternate action mechanism as in claim 37 wherein said ratchet portion is substantially centered in said ratchet cam, and wherein said cam portion comprises a first cam portion, said ratchet cam including a second cam portion, said first and second cam portions being disposed on opposing sides of said ratchet portion of said ratchet cam.

48. An alternate action mechanism as in claim 46 wherein said high cam surfaces extend beyond said frame to actuate said resilient contact.

49. An alternate action mechanism as in claim 37, said actuating apparatus comprising a push button, including an interface member, the axis defining a projected angle of greater than 0 degrees and up to 90 degrees with respect to the direction of movement of said interface member.

50. A portable flashlight, said flashlight comprising:

(a) a housing;

(b) an alternate action switch mounted through a first opening in a side portion of said housing, said switch including (i) a frame, said frame including a detent extending inwardly therefrom, (ii) a resilient switch contact element, (iii) a ratchet cam supported from said frame, said ratchet cam having a ratchet portion including ratchet teeth, and (iv) a push button, said push button extending through the first opening in said housing, said push button having an interface member extending inwardly of said housing, and contacting said ratchet cam when said push button is depressed;

(c) a light source mounted in a second opening in said housing;

(d) a portable energy source contained within said housing, said portable energy source having first and second electric terminals; and (e) electric conductors for connecting said alternate action switch in a closed circuit, including a first electric conductor adjacent said switch contact element;

said resilient switch contact element successively opening and closing the electric circuit when said interface member rotates said ratchet cam thus causing said resilient switch contact element to alternately move between first and second positions, said switch contact element contacting said electric conductor in said first position and not contacting said electric conductor in said second position, said detent engaging said ratchet teeth of said ratchet portion to cause an audible sound when said ratchet cam advances.

51. A portable flashlight as in claim 50 wherein said ratchet cam comprises first and second cam portions having a common axis of rotation, each said cam portion respectively comprising at least two pairs of alternating high and low cam surfaces to actuate said resilient switch contact element, said ratchet portion being substantially centered in said ratchet cam, said first and second cam portions being disposed on opposing sides of said ratchet portion of said ratchet cam.

52. A portable flashlight as in claim 50 wherein said interface member comprises at least one finger, contacting said ratchet cam when said push button is depressed.

53. A portable flashlight as in claim 50 wherein said switch is free from springs.

54. A portable flashlight as in claim 50, said frame of said alternate action switch comprising a base structure defining an outer perimeter of said frame and having a third opening disposed inwardly of the outer perimeter, a plate oriented in substantially the same plane as said base structure and mounted to and extending inwardly from one side of said base structure at the outer perimeter, ratchet cam support arms secured to and extending inwardly from the outer perimeter of said frame, said ratchet cam support arms being disposed on either side of said plate and extending inwardly beyond said plate.

55. A portable flashlight as in claim 54, said frame comprising a pair of detents between said ratchet cam support arms, said ratchet cam comprising first and second ratchet portions, said ratchet cam support arms extending a greater distance inward from the perimeter than said pair of detents and in substantially the same direction as said pair of detents, said detents engaging ratchet teeth of said first and second ratchet portions.

56. A portable flashlight as in claim 50 wherein said ratchet cam comprises a cam portion having an axis of rotation, and comprising at least two pairs of alternating high and low cam surfaces to actuate said resilient switch contact element, and said ratchet cam comprising first and second ratchet portions mounted for rotation with said cam portion, each said ratchet portion comprising spaced ratchet teeth, said ratchet teeth rotating in response to force applied by said interface member, said ratchet portions being disposed on opposite sides of said cam portion of said ratchet cam.

57. A portable flashlight as in claim 56, said push button being integral with said interface member, said interface member having a distal end thereof having a U-shape, the distal end of said interface member contacting said ratchet teeth of said first and second ratchet portions, respectively, when said push button is depressed and thereby rotating said ratchet cam, and wherein a hollow region in said U-shaped interface member receives said cam portion when said push button is depressed, and enables said cam portion to rotate freely, including within said hollow region, when said first and second ratchet portions of said ratchet cam are rotated by said push button.

58. A portable flashlight as in claim 56 wherein said resilient switch contact element moves to the first position when one of said high surfaces of said cam portion engages said contact element, said resilient switch contact element returning to the second position when released by said high surface, the second position opening said electric circuit.

59. An alternate action mechanism, comprising:

(a) a frame;

(b) a ratchet cam supported from said frame, said ratchet cam comprising (i) a cam portion, and (ii) a ratchet portion secured to said frame and mounted for rotation with said cam portion, said ratchet portion including spaced ratchet teeth facilitating rotating of said ratchet cam about a first axis;

(c) a resiliently deflectable push button having an interface member thereon, said interface member, during deflection of said push button, from a first rest position to a second pushed position, rotating said ratchet cam and thereby actuating said alternate action mechanism by pushing against said ratchet teeth to provide a force causing the rotation, said push button and interface member being arranged to rotate said ratchet cam about the first axis in a single direction of rotation, said resiliently deflectable push button being effective to return said push button, including said interface member, to the first rest position when released from the second pushed position; and (d) a resilient contact sufficiently close to said cam portion of said ratchet cam, that depressing said actuating apparatus rotates said ratchet cam and alternately actuates said resilient contact between first and second positions.

60. An alternate action mechanism as in claim 59, said interface member being integral with said push button.

61. An alternate action mechanism as in claim 59, said resiliently deflectable push button comprising rubber.

62. An alternate action mechanism, comprising:

(a) a frame;

(b) a ratchet cam supported from said frame, said ratchet cam comprising (i) a cam portion and (ii) first and second ratchet portions on opposing sides of said cam portion, and mounted for rotation with said cam portion;

(c) actuating apparatus comprising a push button, said push button including an interface member directed toward said ratchet cam, said interface member contacting said first and second ratchet portions and thereby rotating said ratchet cam and thus actuating said alternate action mechanism, when said push button is depressed; and (d) a resilient contact sufficiently close to said cam portion of said ratchet cam that rotating said ratchet cam actuates said resilient contact between first and second positions.

63. An alternate action mechanism as in claim 62, said interface member having a distal end thereof having a U-shape, first and second sides of said interface member at the distal end thereof contacting teeth of said ratchet cam when said push button is depressed to rotate said ratchet cam.

64. An alternate action mechanism as in claim 63 wherein a hollow region in said U-shaped interface member receives said cam portion when said push button is depressed, enabling said cam portion of said ratchet cam to rotate freely therein when said ratchet cam is rotated by said interface member.

65. An alternate action mechanism, comprising:

(a) a frame;

(b) a ratchet cam supported from said frame such that said frame circumscribes said ratchet cam, said ratchet cam comprising (i) a cam portion and (ii) a ratchet portion secured to said cam portion, and mounted to said frame for rotation with respect to said frame;

(c) actuating apparatus comprising a push button, said push button including an interface member directed toward said ratchet cam; and (d) a resilient contact sufficiently close to said cam portion such that rotating said ratchet cam actuates said resilient contact between first and second positions.

* * * * *